US011385021B1

(12) United States Patent
Graf

(10) Patent No.: US 11,385,021 B1
(45) Date of Patent: Jul. 12, 2022

(54) SUPPORT HOOK ASSEMBLY

(71) Applicant: Joseph William Graf, Tahuya, WA (US)

(72) Inventor: Joseph William Graf, Tahuya, WA (US)

( * ) Notice: Subject to any disclaimer, the term of this patent is extended or adjusted under 35 U.S.C. 154(b) by 6 days.

(21) Appl. No.: 17/127,534

(22) Filed: Dec. 18, 2020

Related U.S. Application Data

(60) Provisional application No. 62/949,941, filed on Dec. 18, 2019.

(51) Int. Cl.
*F41C 33/00* (2006.01)

(52) U.S. Cl.
CPC ..... *F41C 33/007* (2013.01)

(58) Field of Classification Search
CPC ..... F41C 33/007; A45F 5/021; A45F 2200/0575; A45F 2005/028; A47G 25/06; B25H 3/006
USPC ..... 224/268
See application file for complete search history.

(56) References Cited

U.S. PATENT DOCUMENTS 475,640 A * 5/1892 Unger ..... F41C 33/007 224/907
2,597,174 A * 5/1952 Patton ..... E05D 3/02 16/221
2,856,111 A * 10/1958 Wolfe ..... F41C 33/007 224/907
4,962,873 A * 10/1990 Schattel ..... A45F 5/00 224/678
D505,545 S * 5/2005 Kay ..... D8/367
8,025,193 B1 * 9/2011 Gornall, Jr. ..... A45F 5/00 224/268
9,844,257 B2 * 12/2017 Kinskey ..... A45F 5/021
2005/0150920 A1 * 7/2005 Schuster ..... A45F 5/021 224/269

* cited by examiner

*Primary Examiner* — Adam J Waggenspack
(74) *Attorney, Agent, or Firm* — Plager Schack LLP; Mark H. Plager; Michael J. O'Brien

(57) ABSTRACT

A support hook assembly is configured to support a rifle worn by a human. The support hook assembly has a clip having a front plate connected to a pair of clip legs. A hook attachment block is joined to the front plate and further has a first pin slot and a second pin slot. An upper hinge knuckle recess, a first lower knuckle recess and a second lower knuckle recess are joined to the front plate adjacent to the hook attachment bloc. A hook has an upper knuckle and a lower knuckle. A pin is inserted through the upper knuckle, the first pin slot, and the lower knuckle. The hook is adapted to support the rifle worn by the human.

4 Claims, 5 Drawing Sheets

SUPPORT HOOK ASSEMBLY

RELATED APPLICATION

This application claims priority to provisional patent application U.S. Ser. No. 62/949,941 filed on Dec. 18, 2019, the entire contents of which is herein incorporated by reference.

BACKGROUND

The embodiments herein relate generally to clothing and personnel accessories.

Prior to embodiments of the disclosed invention, while walking or on patrol one's weapon was heavy and the sling of the weapon pulled on the back of a user's neck.

SUMMARY

A support hook assembly is configured to support a rifle worn by a human. The support hook assembly has a clip having a front plate connected to a pair of clip legs. A hook attachment block is joined to the front plate and further has a first pin slot and a second pin slot. An upper hinge knuckle recess, a first lower knuckle recess and a second lower knuckle recess are joined to the front plate adjacent to the hook attachment bloc. A hook has an upper knuckle and a lower knuckle. A pin is inserted through the upper knuckle, the first pin slot, and the lower knuckle. The hook is adapted to support the rifle worn by the human.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
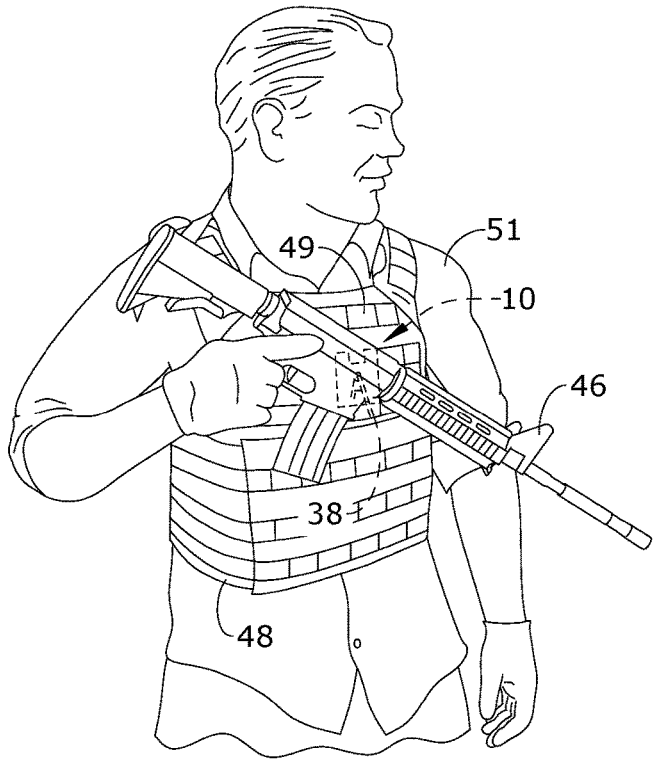
FIG. 1 shows a perspective view of one embodiment of the present invention, shown in use.
Figure 2:
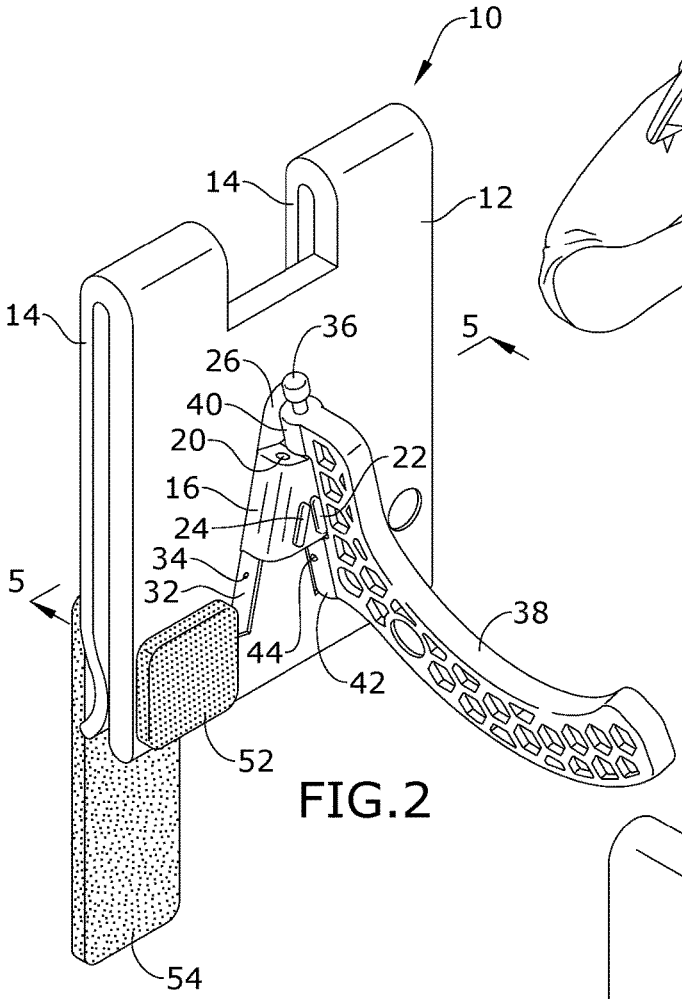
FIG. 2 shows a front perspective view of one embodiment of the present invention.
Figure 3:
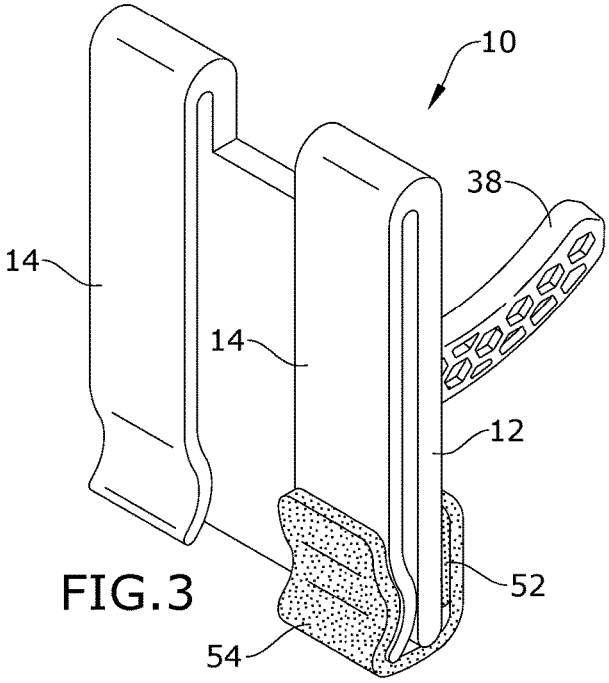
FIG. 3 shows a rear perspective view of one embodiment of the present invention.
Figure 4:
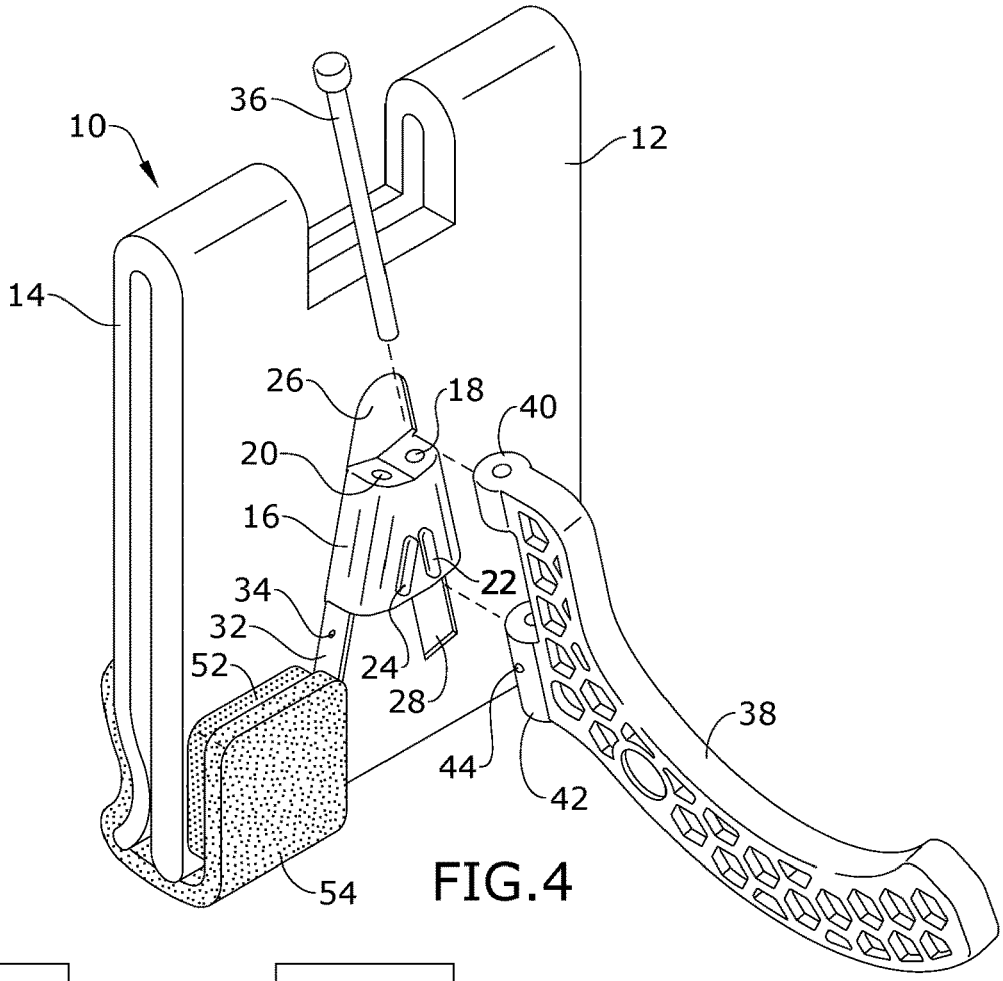
FIG. 4 shows an exploded view of one embodiment of the present invention.
Figure 5:
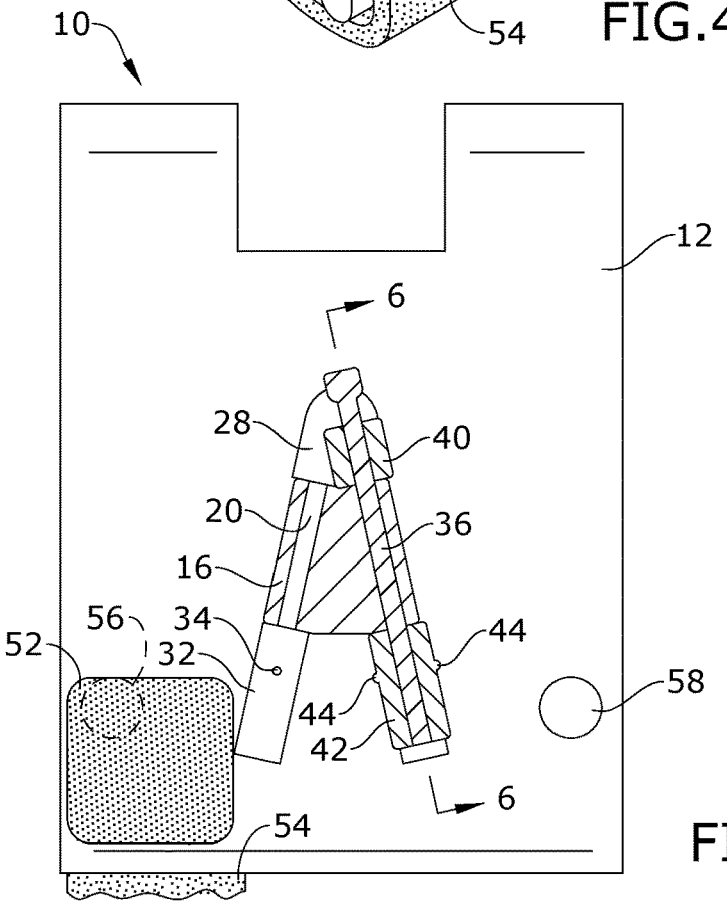
FIG. 5 shows a section view of one embodiment of the present invention taken along line 5-5 in FIG. 2.
Figure 6:
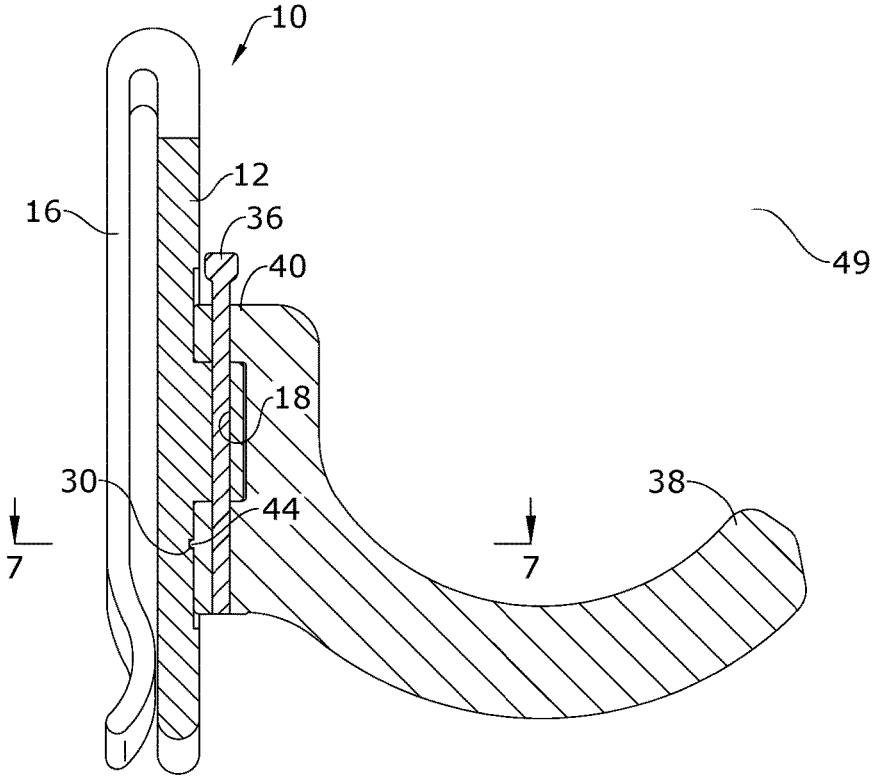
FIG. 6 shows a section view of one embodiment of the present invention taken along line 6-6 in FIG. 5.
Figure 7:
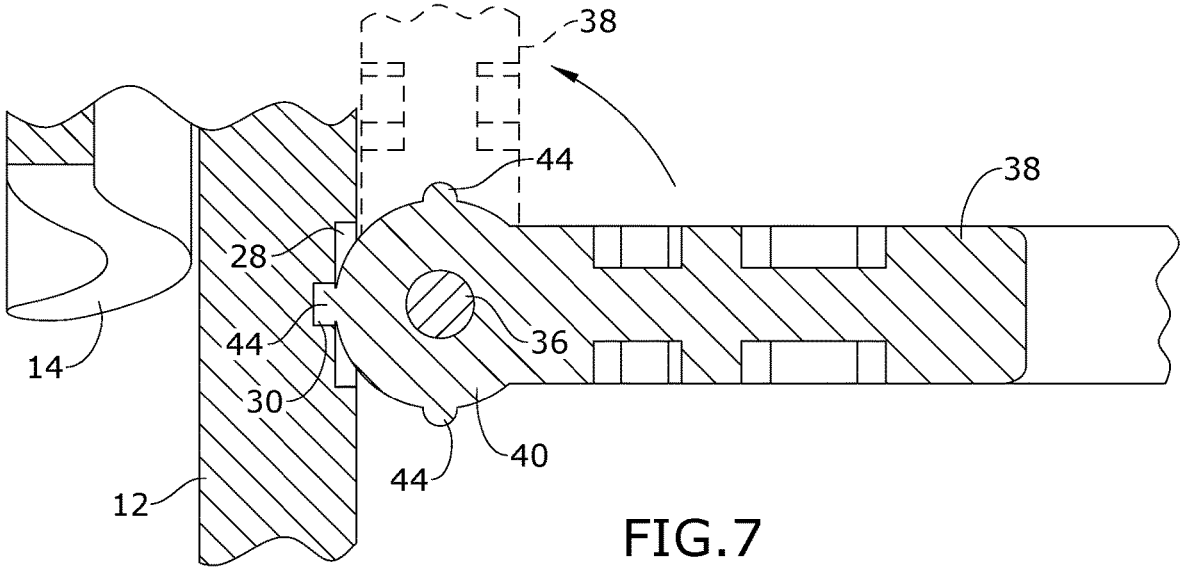
FIG. 7 shows a section view of one embodiment of the present invention taken along line 7-7 in FIG. 6.
Figure 8:
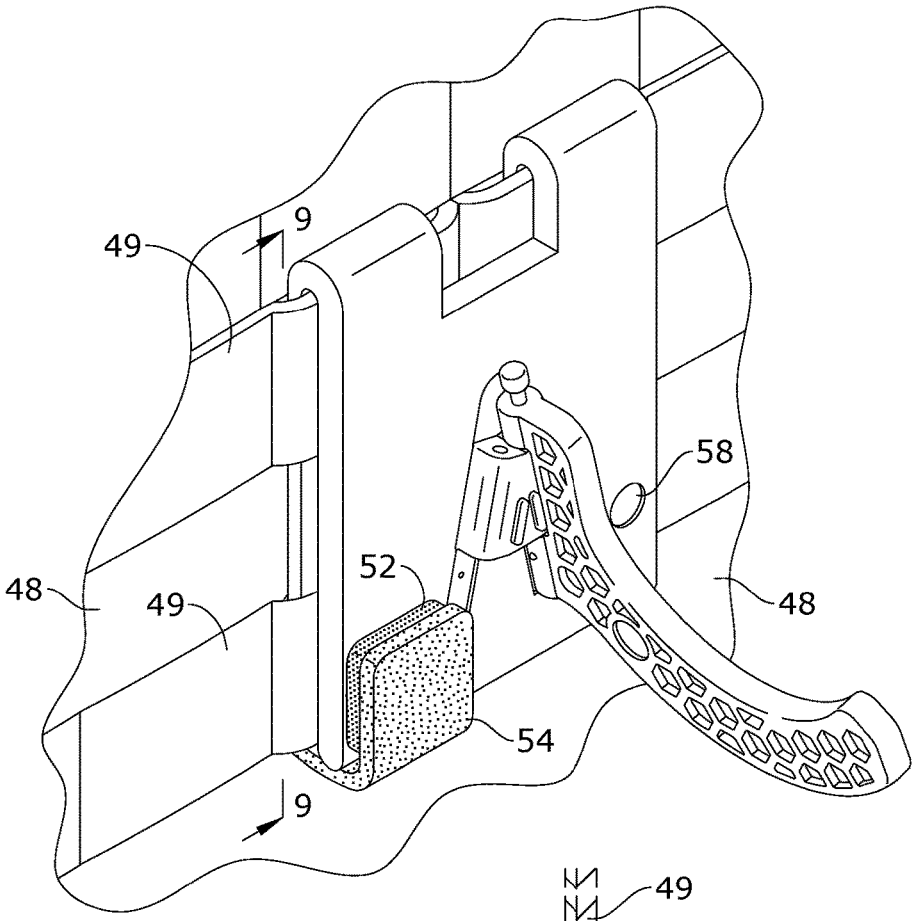
FIG. 8 shows a perspective view of one embodiment of the present invention shown installed.
Figure 9:
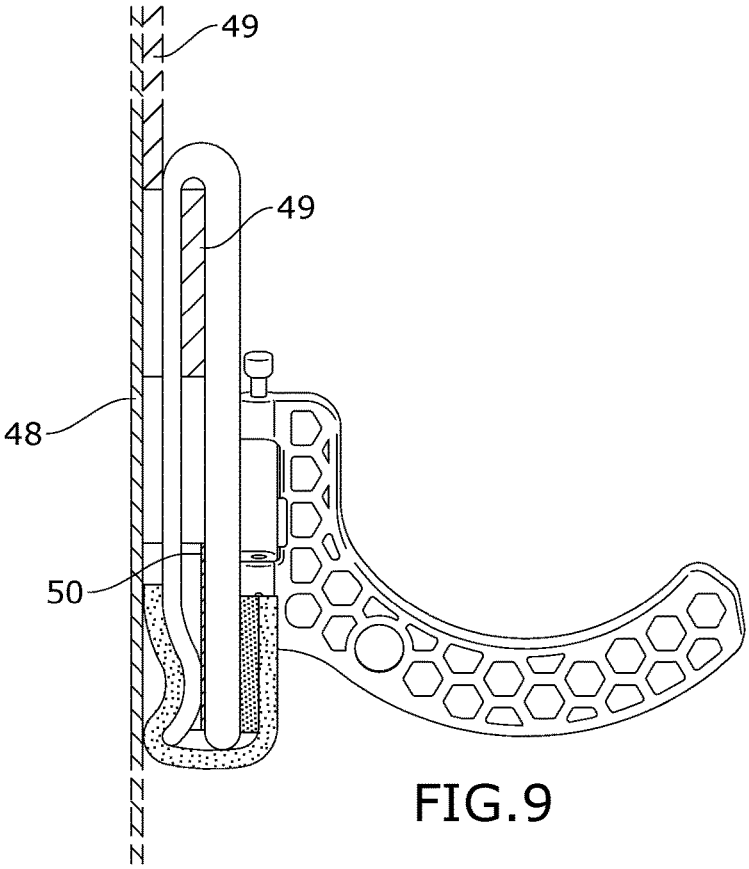
FIG. 9 shows a section view of one embodiment of the present invention taken along line 9-9 in FIG. 8.
Figure 10:
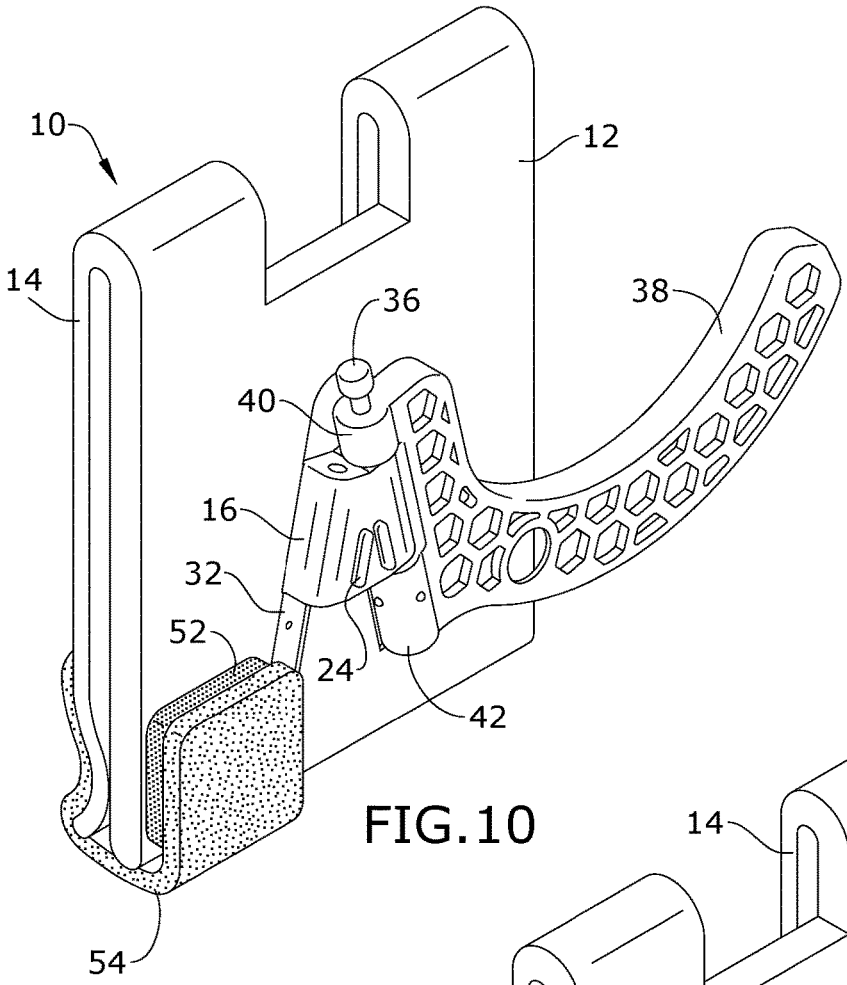
FIG. 10 shows a perspective view of one embodiment of the present invention.
Figure 11:
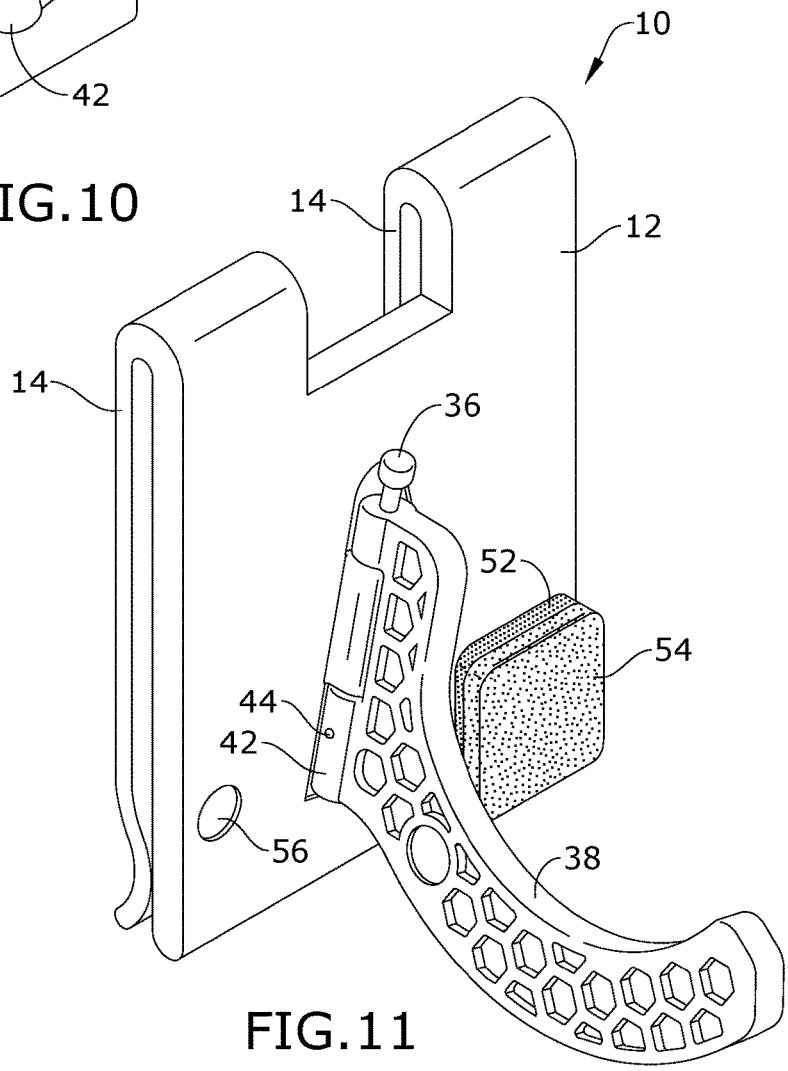
FIG. 11 shows a perspective view of one embodiment of the present invention.

By way of example, and referring to FIGS. 1-11, one embodiment of a clip assembly 10 further comprises a front plate 12 joined to clip legs 14. The front plate 12 is joined to a hook attachment block 16. The hook attachment block

16 further comprises a first pin slot 18, a second pin slot 20, a first stop ridge 22 and a second stop ridge 24.

Above the first pin slot 18 and the second pin slot 20 is an upper hinge knuckle recess 26. Beneath the first pin slot 18 is a first lower hinge knuckle recess 28 having a first detent 30. Beneath the second pin slot 20 is a second lower hinge knuckle recess 32 having a second detent 34.

A hook 38 is joined to an upper hinge knuckle 40 and a lower hinge knuckle 42. The lower hinge knuckle 42 is joined to a first position lock nub 44 and a second position lock nub 44.

In a first mode of operation, a pin 36 is inserted through the upper hinge knuckle 40, the first pin slot 18 and the lower hinge knuckle 42. In a second mode of operation, the pin 36 is inserted through the upper hinge knuckle 40, the second pin slot 20 and the lower hinge knuckle 42.

Turning to FIG. 1, a user 51 is wearing a body armor vest 48. The body armor vest 48 further comprises looped fastener Modular Lightweight Load-carrying Equipment (MOLLE) rails 49 and elastic fabric MOLLE rails 50. The user 51 can insert the clip assembly 10 onto the looped fastener MOLLE rails 49 and the elastic fabric MOLLE rails 50 in order to support a rifle 46 on the hook 38.

Turning to FIGS. 1-11, in some embodiments a hooked fastener pad 52 can be joined to the front plate 12. A looped fastener strip 54 can be used to further connect the clip assembly 10 to the body armor vest 48.

In some embodiments an opening can be arranged in the hook 38 to accommodate a first magnet. A second magnet 56 can be arranged on the front plate 12. The first magnet can be joined to the second magnet 56 holding the hook 38 to the front plate 12.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A support hook assembly, configured to support a rifle worn by a human; the support hook assembly comprises:

a clip having a front plate connected to a pair of clip legs;

a hook attachment block, joined to the front plate and further comprising a first pin slot and a second pin slot;

an upper hinge knuckle recess, a first lower knuckle recess and a second lower knuckle recess, on the front plate adjacent to the hook attachment block;

a hook having an upper knuckle in the upper knuckle recess and a lower knuckle in the lower knuckle recess;

a pin, inserted through the upper knuckle, the first pin slot, and the lower knuckle;

wherein the hook is adapted to support the rifle worn by the human.

2. The support hook assembly of claim 1, wherein the hook attachment block further comprises a first stop ridge and a second stop ridge.

3. The support hook assembly of claim 2, further comprising a hook fastener joined to one of the clip legs and a loop fastener joined to the front plate.

4. The support hook assembly of claim 3, further comprising glue, binding the pin to the hook attachment block.

* * * * *